US008186320B2

(12) United States Patent
Schiepp et al.

(10) Patent No.: US 8,186,320 B2
(45) Date of Patent: May 29, 2012

(54) DEVICE FOR CAMSHAFT ADJUSTMENT IN AN INTERNAL COMBUSTION ENGINE

(75) Inventors: Thomas Schiepp, Seitingen-Oberflacht (DE); Thomas Golz, Sipplingen (DE); Werner Janisch, Owingen (DE)

(73) Assignee: ETO Magnetic GmbH, Stockach (DE)

( * ) Notice: Subject to any disclaimer, the term of this patent is extended or adjusted under 35 U.S.C. 154(b) by 301 days.

(21) Appl. No.: 12/514,510

(22) PCT Filed: Aug. 5, 2008

(86) PCT No.: PCT/EP2008/006417

§ 371 (c)(1),
(2), (4) Date: Jan. 20, 2010

(87) PCT Pub. No.: WO2009/018991

PCT Pub. Date: Feb. 12, 2009

(65) Prior Publication Data

US 2010/0126445 A1 May 27, 2010

(30) Foreign Application Priority Data

Aug. 7, 2007 (DE) ..... 10 2007 037 232

(51) Int. Cl.
*F01L 1/34* (2006.01)

(52) U.S. Cl. ..... 123/90.18

(58) Field of Classification Search ..... 123/90.1, 123/90.15–90.18, 90.6, 90.21
See application file for complete search history.

(56) References Cited

U.S. PATENT DOCUMENTS

| | | | | |
|---|---|---|---|---|
| 5,289,806 | A * | 3/1994 | Hurr | 123/90.17 |
| 7,404,383 | B2 * | 7/2008 | Elendt | 123/90.16 |
| 7,472,671 | B2 * | 1/2009 | Elendt et al. | 123/90.6 |
| 2010/0126447 | A1 * | 5/2010 | Talan et al. | 123/90.17 |
| 2010/0269769 | A1 * | 10/2010 | Schoeneberg et al. | 123/90.6 |

FOREIGN PATENT DOCUMENTS

| | | |
|---|---|---|
| DE | 19611641 | 6/1997 |
| DE | 10148177 | 4/2003 |
| DE | 10148178 | 4/2003 |
| DE | 102005003079 | 8/2006 |
| GB | 10648 | 0/1912 |
| JP | 52044314 | 4/1977 |

* cited by examiner

*Primary Examiner* — Thomas Denion
*Assistant Examiner* — Daniel Bernstein
(74) *Attorney, Agent, or Firm* — Bachman & LaPointe, P.C.

(57) ABSTRACT

The invention relates to a device for camshaft adjustment in an internal combustion engine, having a lifting profile element which is provided in a rotationally fixed manner on an axially movable mounted camshaft and which provides a control groove, and having a control unit for generating a predetermined axial movement of the camshaft, wherein the control unit has a tappet unit which is preferably movable radially with respect to the camshaft and which is designed to controllably engage into the lifting profile element, wherein the lifting profile element forms a first control groove which is designed to interact with the tappet unit at a first penetration depth in order to describe a first axial movement of the camshaft, and the lifting profile element forms a second control groove which is designed to interact with the tappet unit at a second penetration depth, which differs from the first penetration depth, in order to describe a second axial movement, which differs from the first axial movement, of the camshaft.

14 Claims, 6 Drawing Sheets

DEVICE FOR CAMSHAFT ADJUSTMENT IN AN INTERNAL COMBUSTION ENGINE

BACKGROUND OF THE INVENTION

The present invention relates to a device for camshaft adjustment of an internal combustion engine according to the preamble of the main claim. In addition, the present invention relates to a method for camshaft adjustment, more preferably method for operating a generic device of this type.

A device according to the preamble of the main claim is known from DE 196 11 641 C1. This publication describes the inventive background and context, including the constructive realisation of the camshaft, its mounting as well as its interaction with the internal combustion engine, which will not be discussed in the present application in detail.

Specifically, this known device according to the preamble describes how an actuation element (tappet or actuation pin) through interaction with a lifting profile assigned to the cam can bring about axial, predetermined adjustment of the camshaft for example with the purpose of offering a cam various switchable cam tracks.

Here, the known device typically requires a plurality of tappets (actuation pins) such as can be seen in FIG. 2 of DE 196 11 641 C1 so that, depending on the axial displacement position of the lifting profile arrangement, a pin in each case suitably located opposite is able to engage and bring about the intended axial displacement in each case. This is expensive in terms of design and requires a correspondingly large installation space at the place of use.

The object of the present invention is to simplify the design of a device according to the preamble controlled by means of tappets, more preferably to render the provision of a plurality of axially spaced tappets (actuation pins) unnecessary and to increase operational safety and maintenance friendliness.

SUMMARY OF THE INVENTION

The object is solved through a device for camshaft adjustment of an internal combustion engine having a lifting profile element which is provided in a rotationally fixed manner on an axially moveably mounted camshaft and which provides a control groove and having a control unit for generating a predetermined axial movement of the camshaft, wherein the control unit has a tappet unit which is preferably moveable radially with respect to the camshaft and which is designed to controllably engage in the lifting profile element, characterized in that the lifting profile element forms a first control groove which for interaction with the tappet unit is designed to interact with the tappet unit at a first penetration depth for describing a first axial movement of the camshaft and the lifting profile element forms a second control groove which is designed to interact with the tappet unit at a second penetration depth which differs from the first penetration depth in order to describe a second axial movement of the camshaft which differs from the first axial movement.

According to the invention, the two different penetration depths (according to the further development in connection with a multi-part tappet) according to the invention advantageously make it possible that at a (single) axial installation place the tappet unit can be provided which, depending on set activation (penetration depth and/or width of the engagement section of the tappet), can selectively choose and run on the control grooves (groove tracks), by means of which upon rotation of the lifting profile element the intended respective axial adjustment of the camshaft is then brought about.

In preferred embodiments the tappet is formed in multiple parts through tappet elements guided within one another (inner/outer tappets), advantageously according to the further development in connection with an assigned electromagnetic setting device, which assigns to each tappet an anchor unit each of which can be further preferably driven or moved separately.

In the context of the present invention protection is claimed for each of the features claimed in the application documents, wherein in addition the disclosure content of DE 196 11 641 with respect to the design realisation of the displaceably mounted camshaft and the internal combustion engine context is to be considered as belonging to the invention is included in the present application.

BRIEF DESCRIPTION OF THE DRAWINGS

Further advantages, features and details of the invention are obtained from the following brief description of the exemplary embodiments as well as from the drawings; these show in FIG. 1 to FIG. 4: various perspective or lateral views of a lifting profile element according to a first exemplary embodiment of the invention as it can be provided on a camshaft in a rotationally fixed manner for bringing about the camshaft adjustment.

DETAILED DESCRIPTION

FIGS. 1 to 4 explain how the control grooves (in the manner of tracks) run in the shown lifting profile element (cam piece); as is more preferably shown in this context by FIGS. 9 to 11, the tappet unit comprises an inner tappet 10 (forming a narrow engagement region 11) and a sleeve-shaped outer tappet 12 surrounding said inner tappet, wherein in a manner to be described in the following, both tappets can be actuated independently of each other through electromagnetic activation. Here, the inner tappet makes possible realising a greater penetration depth (in conjunction with a narrower groove profile, FIGS. 3, 4), the wider outer tappet (hollow tappet) cannot completely penetrate into the depth of a groove forming such a narrow base area.

Figure 9:
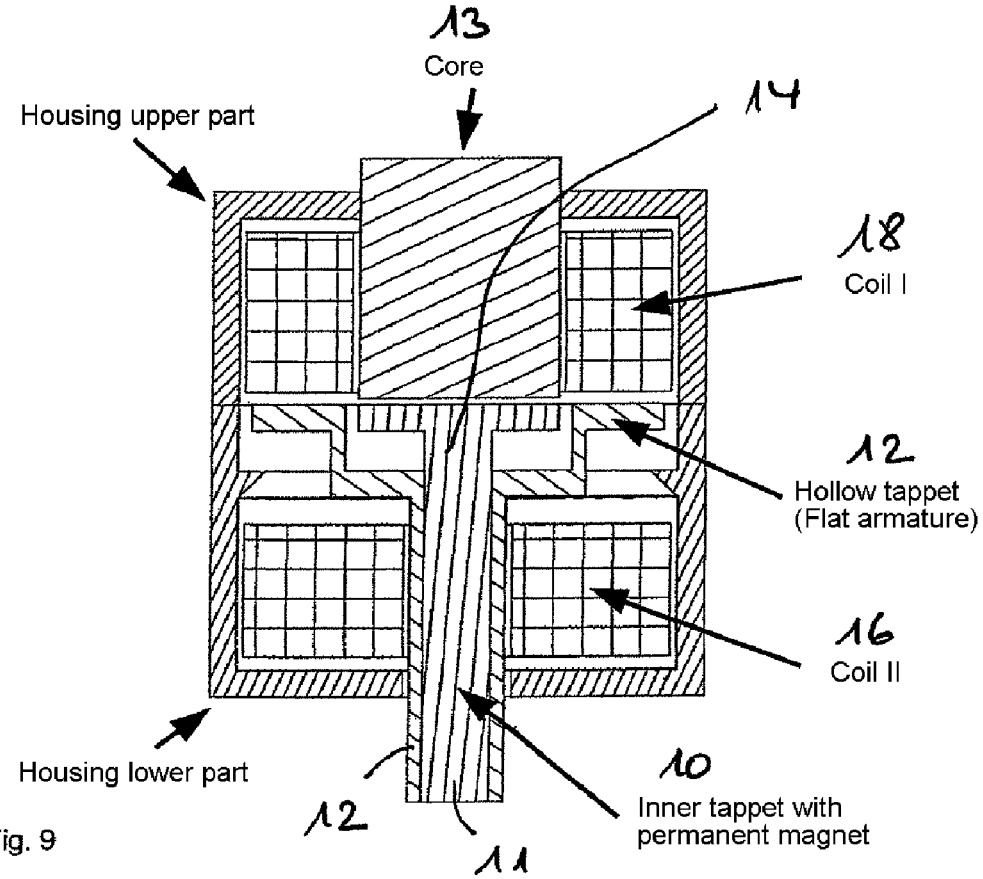
FIG. 9 to FIG. 11: Longitudinal sections through an electromagnetic adjusting device which on the end side forms a tappet divided into a plurality of parts for realising the tappet element.
Figure 10:
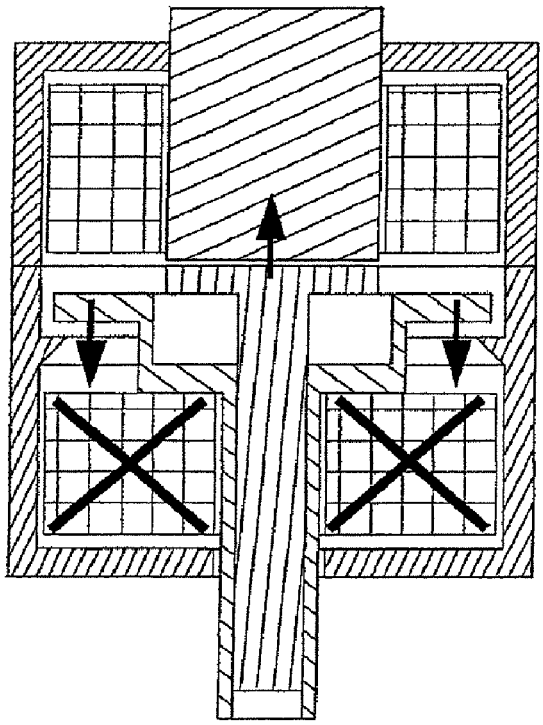
Figure 11:
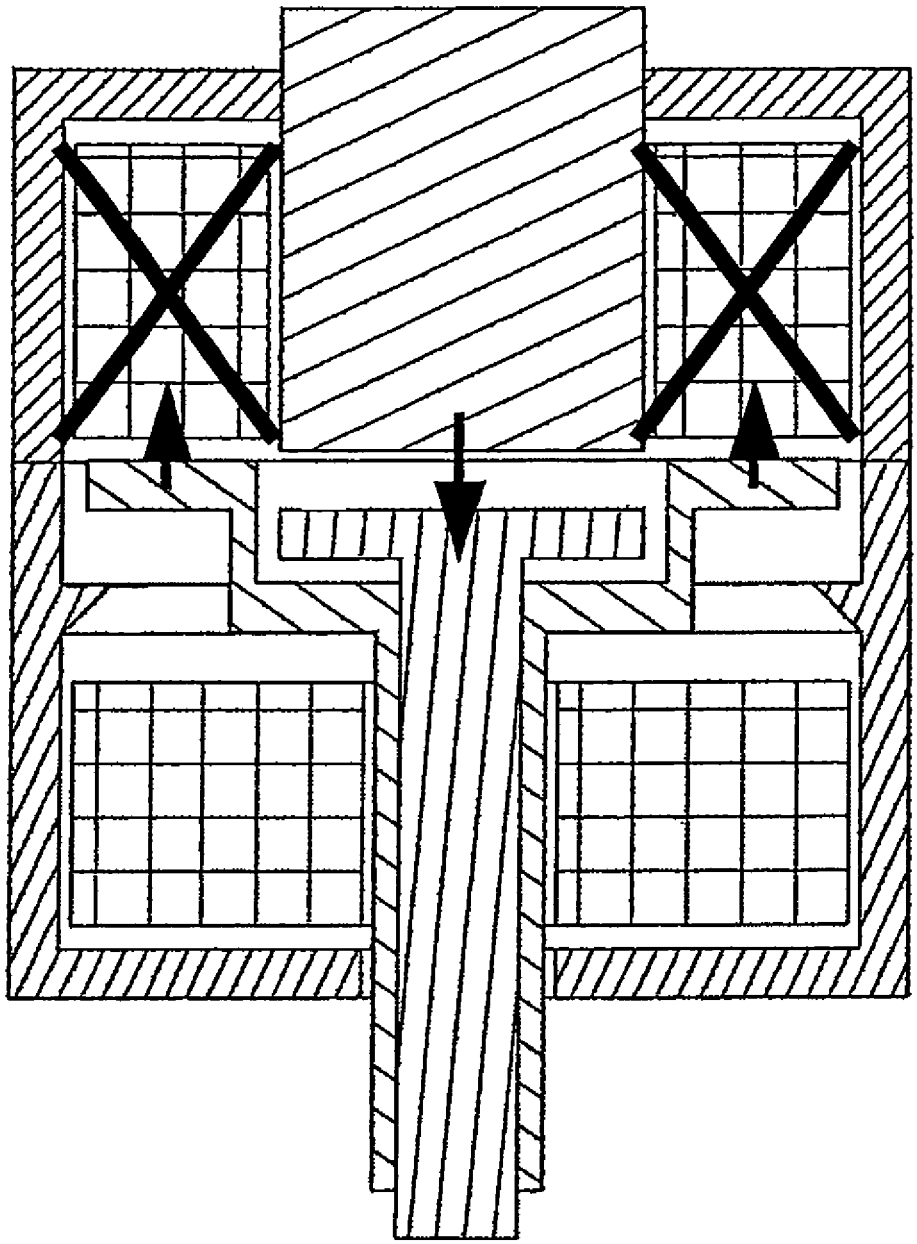

Advantageously according to the invention the present invention makes it possible by means of a tappet unit divided in two exemplarily shown in FIGS. 9 to 11 to altogether realise a relative movement (axial displacement) of the lifting profile element between three positions (with the effect that a single—multi-part—tappet unit has to be installed and accordingly no additional axial installation space with corresponding additional expenditure is required).

The developments of FIGS. 5 to 8 of the respective groove track courses (control grooves) are symbolised through bold black lines or line portions (i.e. wide groove) as well as dashed/dotted groove track courses (narrow groove) in the case of overlapping also as a narrow groove running lowered within a wide groove. Furthermore, the tappet divided in two is symbolised through a black dot (FIG. 1, FIG. 8, namely activation through the inner tappet), as well as a circle or ring as symbol (FIG. 6, FIG. 7), corresponding to the sleeve-shaped hollow or outer tappet.

Figure 1:
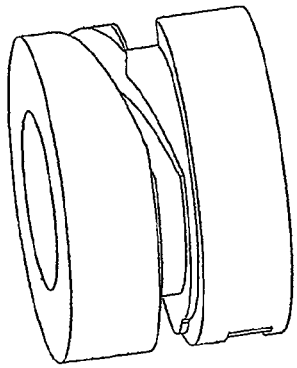
Figure 2:
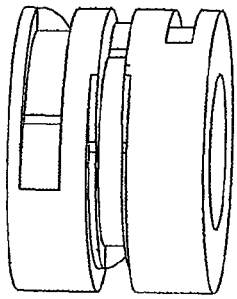
Figure 3:
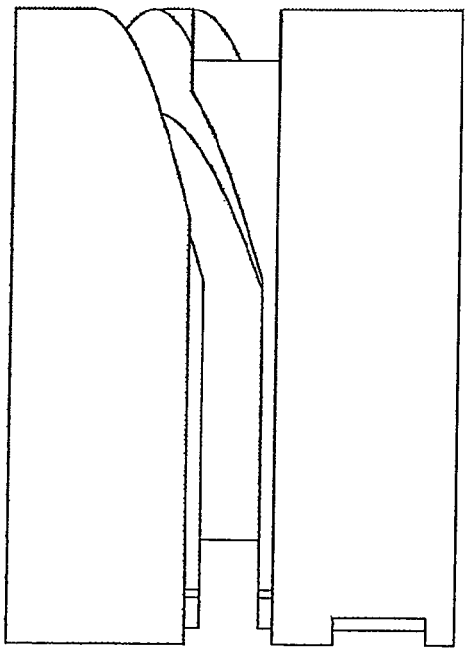
Figure 4:
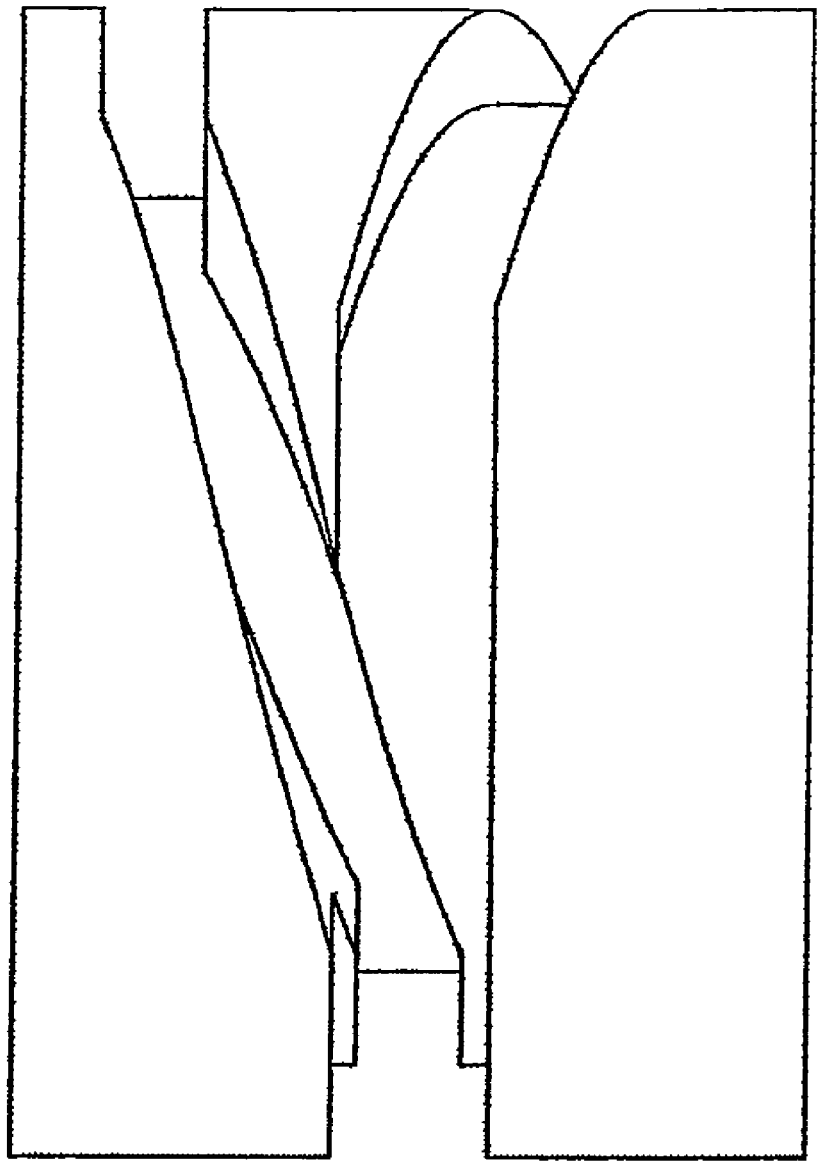
Figure 5:
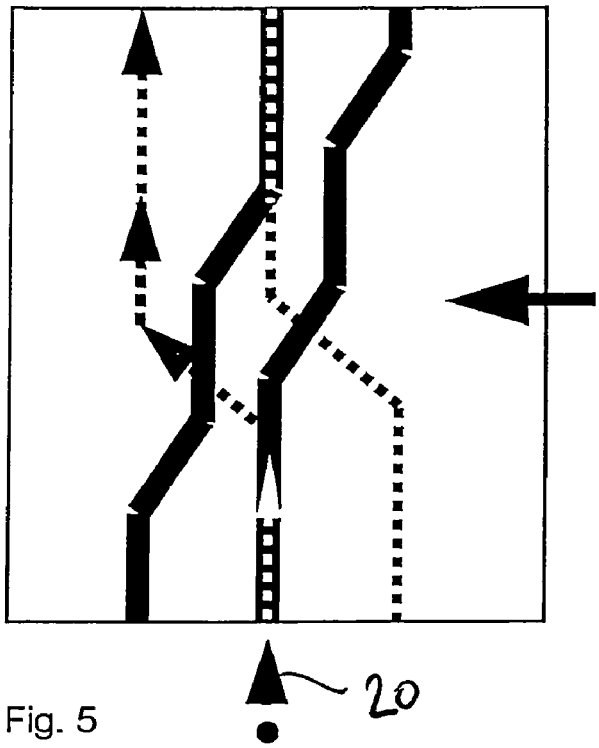
FIG. 5 to FIG. 8: 4 possible adjusting operations as they are possible in the first exemplary embodiment of the present invention in the form of a groove course in the lifting profile element shown developed in FIGS. 1 to 4.
Figure 6:
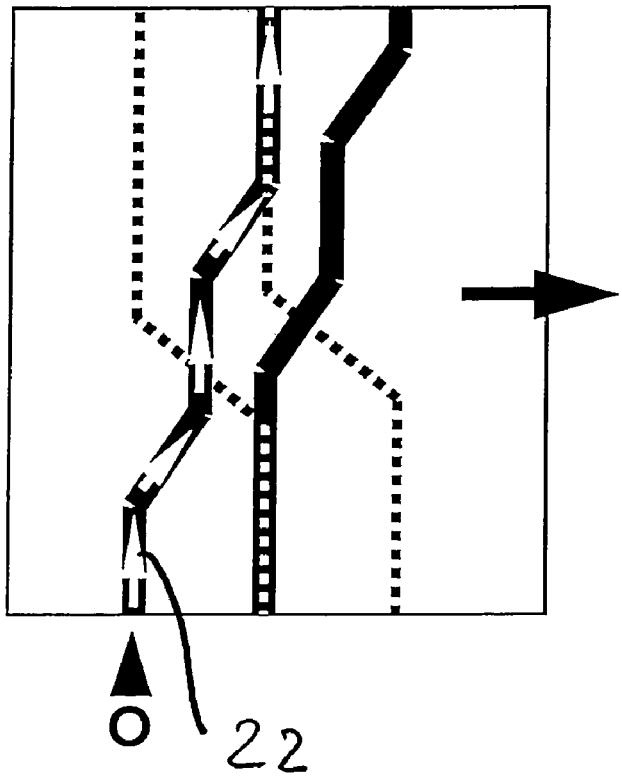

FIG. 5 initially explains how through engagement of the extended inner tappet 10 in the deep groove (arrow course 20 of FIG. 5) shown a displacement to the right of the crank is brought about as far as to the position of FIG. 6 (the tappet position remains unchanged with all examples). In the position of FIG. 6 the outer tappet, for the purpose of guiding back into a basic position (middle position) would describe the wide groove track described with arrows 22 so that the shown rocker arm is then displaced from the right position back into the basic position (middle position).

Figure 7:
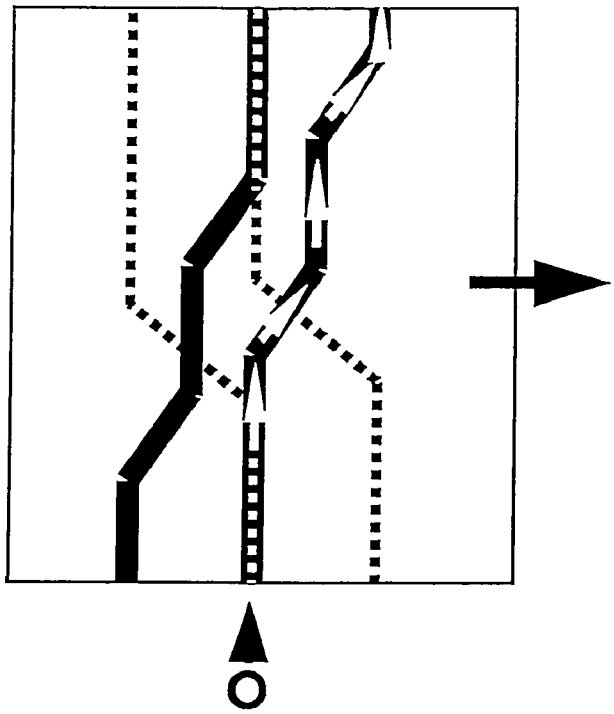
Figure 8:
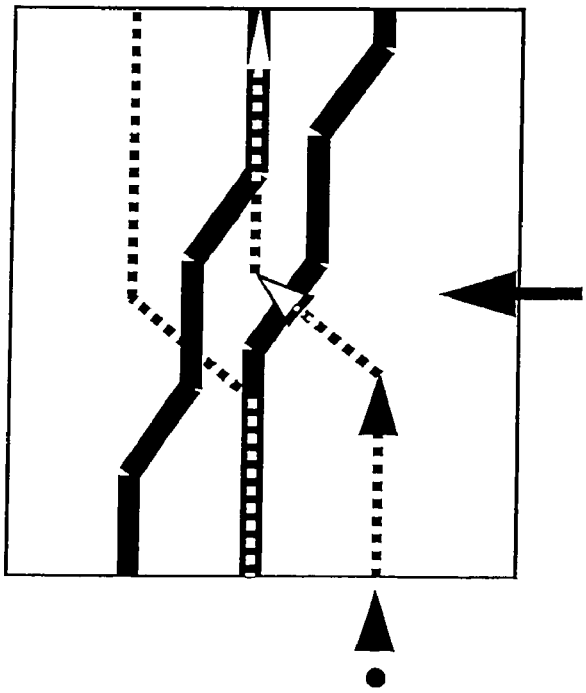

FIG. 7 then shows how from the middle position displacement to the left is brought about by means of the outer sleeve; FIG. 8 explains the setting back from the left position into the basic position (middle position) by means of the inner tappet. To that extent the groove or track courses of FIGS. 5 to 8 serve to further explain the design structure of the lifting profile element according to the exemplary embodiment of FIGS. 1 to 4.

FIGS. 9 to 11 show in schematic form the design realisation of the actuation device as electromagnetic adjusting device with two armatures; an inner tappet—(armature 10), which for interaction with a (stationary) core 13 comprises a permanent magnet 14, and a second armature 12, which merges with the hollow tappet.

By electrifying a coil II (reference number 16) the flat armature (thus the hollow tappet 12) is moved downwards. The permanent magnet 14 of the inner tappet 10 in contrast ensures that during this operating process the inner tappet remains on the core 13 and thus in the pushed-in position shown in FIG. 9.

FIG. 10 shows the hollow tappet extended in this manner; a marking "X" of one of the coils symbolises the electrified state.

For extending the inner tappet the permanent magnet has to be repulsed by a coil I (reference number 18) (surrounding the core 13) (upon suitable electrification of the coil I). In the process, the hollow tappet is automatically pulled in the drawing plane upwards (by means of the flat armature) so that the hollow tappet cannot be extended, the operating state according to FIG. 11 results.

The invention claimed is:

1. A device for camshaft adjustment of an internal combustion engine comprising:

a lifting profile element which is provided in a rotationally fixed manner on an axially moveably mounted camshaft, a control unit for generating a predetermined axial movement of the camshaft, wherein the control unit has a tappet unit which is moveable radially with respect to the camshaft and which is designed to controllably engage in the lifting profile element, the lifting profile element forms a first control groove which, for interaction with the tappet unit, is designed to interact with the tappet unit at a first penetration depth for describing a first axial movement of the camshaft, and the lifting profile element forms a second control groove which is designed to interact with the tappet unit at a second penetration depth which differs from the first penetration depth in order to describe a second axial movement of the camshaft which differs from the first axial movement.

2. The device according to claim 1, wherein the first and the second control groove are provided adjacently to each other in a common lifting profile element and/or a lifting profile element embodied in one piece.

3. The device according to claim 1, wherein the first and the second control groove in the lifting profile element merge with each other at least in regions.

4. The device according to claim 1, wherein the tappet unit is designed so that the tappet unit for engaging in the first and in the second control groove can be switched on an engagement side between the first and the second penetration depth and/or can be adjusted or switched for forming an engagement region that is variable in width.

5. The device according to claim 4, wherein the tappet unit on the engagement side comprises a cylindrical arrangement with an inner tappet and a sleeve-like outer tappet concentrically surrounding said inner tappet.

6. The device according to claim 5, wherein the inner tappet and the outer tappet are assigned to the first and the second control groove respectively and/or the first and the second penetration depth respectively.

7. The device according to claim 5, wherein the inner tappet and the outer tappet are designed activatable and/or operable independently of each other.

8. The device according to claim 1, wherein the first and the second control groove are designed so that through the effect of the control unit activating the tappet unit the camshaft can be adjusted by means of a first axial movement and a second axial movement from a starting position into a first axially displaced position and back into a basic position.

9. The device according to claim 8, wherein the lifting profile element comprises a third control groove adjacent to and partially overlapping the first and the second control groove and the third control groove describes a third axial movement of the camshaft, wherein the third control groove is designed so that through the effect of the control unit activating the tappet unit the camshaft can be moved from the starting position or the first axially displaced position into a second axially displaced position which differs from the starting position and the first axially displaced position.

10. The device according to claim 9, wherein the first, second and third control groove are designed so that the camshaft through the effect of the control unit activating the tappet unit can be adjusted between three axial displacement positions differing from one another as desired.

11. The device according to any claims 1, wherein the tappet unit is driven by means of an electromagnetic adjusting device, wherein the tappet unit interacts with an armature unit of the electromagnetic adjusting device which is moveable as reaction to electrification of a preferably stationary coil unit.

12. The device according to claim 11, wherein the armature unit is constructed in multiple parts with a first and a second armature corresponding to a tappet unit that is in multiple parts activatable independently of one another.

13. The device according to claim 12, wherein one of the armatures for interacting with a stationary core unit comprises a permanent magnet unit which is equipped so that as reaction to a movement of the other armature the permanent magnet unit prevents the moving of the one armature.

14. A method for operating the device according to claim 1, including the steps:

activating a tappet unit for interacting with a first control groove of a lifting profile element for the axial displacing of a camshaft in a first axially displaced position;

activating the tappet unit for interacting with a second control unit formed in the lifting profile element for displacing the camshaft from the first axial displacement position into a second axial displacement position which differs from the first displacement position, wherein the tappet unit for interacting with the first and the second control groove is switched over between the first and second penetration depth and/or between a first and second engagement width effective for the groove engagement.

* * * * *